United States Patent [19]

Ratliff

[11] Patent Number: 4,623,316

[45] Date of Patent: Nov. 18, 1986

[54] FLOTATION VEST

[76] Inventor: John C. Ratliff, P.O. Box 339, Winchester, Oreg. 97495

[21] Appl. No.: 511,402

[22] Filed: Jul. 7, 1983

[51] Int. Cl.[4] ..... B63C 9/08

[52] U.S. Cl. ..... 441/106; 441/117; 441/118

[58] Field of Search ..... 441/80, 88–101, 441/106, 108, 111, 112, 113, 114, 117, 118, 123, 119; 244/151 R; 182/3, 6; 405/185, 186, 187; 2/247, DIG. 3, DIG. 6, 2.1 R, 82; 224/904

[56] References Cited

U.S. PATENT DOCUMENTS

| | | | |
|---|---|---|---|
| 393,555 | 11/1888 | Griffin | 224/904 |
| 2,347,010 | 4/1944 | Ward | 441/93 |
| 2,647,293 | 8/1953 | Wintercorn | 182/6 |
| 2,774,979 | 12/1956 | Moran | 441/94 |
| 3,452,374 | 7/1969 | Turner | 441/92 |
| 3,475,774 | 11/1969 | Hawkins | 441/118 |
| 3,559,932 | 2/1971 | Ternes | 244/151 R |
| 3,957,183 | 5/1976 | Gadberry | 224/211 |

FOREIGN PATENT DOCUMENTS

| | | | |
|---|---|---|---|
| 815846 | 6/1969 | Canada | 441/118 |

OTHER PUBLICATIONS

Fastnet Personal Safety Gear by Alantis/Switlik 1981.
Sports Age P.N.R. #1104, 4/5/71.

*Primary Examiner*—Trygve M. Blix
*Assistant Examiner*—Edwin L. Swinehart
*Attorney, Agent, or Firm*—Quaintance, Murphy & Presta

[57] ABSTRACT

A flotation vest in the form of a buoyancy compensator for divers or a PFD (personal flotation device) for canoeists and the like including a collar and waistcoat assembly secured to the body of a user by a modified and simplified parachute style harness. The vest and harness configuration assure that a user will float on a water surface in a stable, head up and out of water position. The buoyancy compensation invention is inflatable and includes connectors for securing a scuba backpack directly thereto, thus eliminating the usual waist buckle of the backpack. The buoyancy compensation invention may include an auxiliary equipment strap, a front mounted equipment pocket and a pair of side pockets for trimming weights and/or an extra second stage of a regulator. The PFD invention is filled with a buoyant foam material and includes a lateral fold between the collar and waistcoat to assure proper and comfortable fit of the PFD against the user's body.

18 Claims, 14 Drawing Figures

FLOTATION VEST

BACKGROUND OF THE INVENTION

This invention relates to vests for use in water, generally, and in particular to an improved flotation vest and harness arrangement. In one form, the vest is a buoyancy compensator particularly useful for skin and scuba diving, and in another embodiment, the flotation vest is a personal flotation device or PFD which is used by canoeists, rafters, etc. The principal difference between the two forms of the invention is that the former is inflatable and deflatable, while the latter is filled with a buoyant, foam material.

In the field of skin and scuba diving, particularly recreational scuba diving, flotation vests or devices have changed rather dramatically since they were first introduced more than 25 years ago. Initially, such devices were intended only for emergency flotation at the surface of a body of water. An early device was simply a slender, pleated tube which was inflated by a $CO_2$ cartridge into a balloon shape when emergency flotation was needed. Soon thereafter, a Mae West vest was developed including an oral inflation tube and a small, $CO_2$ cartridge; either could be used to inflate the vest but, again, this type of vest was designed primarily for emergency flotation.

Somewhat later, it was found that the Mae West type of vest just discussed could be used underwater to trim the diver's specific gravity to neutral buoyancy, at any selected depth. This was accomplished by removing the scuba regulator from the mouth and orally inflating the vest through the oral inflation tube, if the diver was too "heavy" or by releasing some air in the vest through the oral inflation tube if the diver was too "light". Used thusly, the Mae West type of vest became the first buoyancy compensator for divers, but, obviously, improvements were needed.

Later developments included a vest having a greater internal capacity or volume than the early Mae West vest, this later vest also being equipped with an enlarged oral inflation tube with a more comfortable and easily used mouthpiece and an enlarged capacity $CO_2$ cartridge for emergency inflation at the surface or to raise the diver to the surface of a body of water. A significant development thereafter was to provide an inflation device connected to the oral inflation tube, the inflation device being connected by a tube to the tank of air being carried on the diver's back. Thus, buoyancy compensation or control beneath the water could be easily accomplished by simple manipulation of the inflation control without need of removing the scuba regulator from one's mouth followed by oral inflation of the vest.

Later developments lead to three basic types of buoyancy compensators and these reflect the present state of the art, prior to this invention. The first is a chest-mounted vest known in the art as a "horse collar" design, which may be used for scuba diving or skin diving (snorkeling). The other two devices are designed for scuba diving only. The first is a vest which is mounted on the backpack of a conventional scuba tank and backpack assembly and, when inflated, assumes the shape of an inverted "U". This type of vest has an advantage over the horse collar design, in that the diver's chest is free of a vest. However, the principal drawback of this design is that, when fully inflated, it will float a diver on the surface of a body of water in a stable, face down position; in an emergency, particularly if the diver is unconscious, the results could be fatal. A third type of flotation device currently used in scuba diving is a jacket-type of device which is rather permanently affixed to the backpack of a conventional scuba tank and backpack assembly. While satisfactory for scuba diving, the device is cumbersome and somewhat unsuitable for skin diving or snorkeling and, thus, is not used for this purpose.

The prior, patented art includes U.S. Pat. No. 3,269,129 issued to R. C. Zambrano which discloses an early scuba tank backpack including a crotch strap and a waist belt with a buckle. Later, scuba tank backpack developments include U.S. Pat. Nos. 3,174,664 issued to D. L. Hue and 3,957,183 issued to D. L. Gadberry. These latter two patents disclose scuba tank backpacks of the type commonly in use today, with a harness assembly including two shoulder straps and a waist belt with a buckle. The major drawback of this design is that the scuba diver wears a second, weight belt with a belt buckle. In an emergency, the scuba diver may wish to "ditch" the weight belt so as to return to the surface rapidly. However, with two belt buckles at the diver's waist, it can be very difficult to determine which one is the weight belt and which one is the belt holding the scuba tank in place.

An example of the horse collar-type of buoyancy compensator or vest above discussed is disclosed in U.S. Pat. No. 3,536,071 issued to J. V. Ferrando. The design is typical and includes a waist encircling strap with a crotch strap. While this type of vest is useful for both skin and scuba diving, the harness assembly including the waist strap and crotch strap is not at all satisfactory. Specifically, with this arrangement, the diver is free to move inside of the harness and the flotation bag of the vest can easily move out of position Thus, it may be difficult for the diver to control his attitude under water and, at the surface, the diver's head can actually be tilted forward to a stable, face-down position in the water. Obviously, this can be extremely dangerous. All front-mounted buoyancy compensators have this deficiency, and it centers about the center of buoyancy of such buoyancy compensators. A long moment arm of force is created because the diver's center of gravity is at the waist where the weight belt is located, and the center of buoyancy is at the diver's neck. Thus, a stable, vertical attitude with the diver's neck above the diver's waist can be assumed in the water, whereupon the face of the diver is forced downwardly into the water.

There are other difficulties with conventional, chest-mounted, horse collar buoyancy compensators. Since they are bulky, they create resistance when the diver attempts to swim. These devices have uncomfortable harnesses which allow the compensator to move about the diver's body. Such buoyancy compensators have a confusing array of straps and buckles which create unneeded bulk and can easily be confused with the scuba harness and weight belt. With the confusing arrangement of straps and buckles located at the diver's waist, it is very easy for the diver to release the wrong buckle when an attempt is made to ditch the weight belt in an emergency.

In direct contradistinction to the prior art as just discussed, the present invention is an improved flotation vest which is streamlined when compared to the prior art and includes a harness assembly with straps that will not be confused with other equipment worn by the diver, particularly the weight belt and the weight belt buckle. Essentially, the harness is a rather radically modified parachute type harness. Prior U.S. Pat. No. 3,475,774 issued to J. M. Hawkins discloses an inflatable vest and harness for marine life saving which is designed for use by personnel making parachute descents from aircraft. However, this device would be most unsuitable for skin or scuba diving because the harness assembly is far too complex and buoyancy is limited to the collar of the device, thus making underwater buoyancy compensation virtually impossible.

The instantly disclosed and claimed invention provides a streamlined buoyancy compensator which may be intregated with a scuba tank and backpack, if desired, and is extremely comfortable to wear. Uncomplicated and rapid access to the diver's weight belt is assured so that an emergency ascent to the surface, when needed, may be most easily accomplished. Equally importantly, the flotation vest of this invention, in the form of a buoyancy compensator, may be used alone for snorkeling or may be combined with an otherwise conventional scuba tank and backpack assembly for scuba diving. Additionally, another form of the invention is used for white water rafting, canoeing and the like. In this case, the vest is filled with foam material yet it remains comfortable to wear and is also streamlined in configuration.

SUMMARY OF THE INVENTION

Accordingly, it is a principal object of the invention to provide a flotation vest in the form of a buoyancy compensator for divers or a personal flotation device for canoeists and the like, the vest including a collar and waist coat assembly secured to the body of a user by a modified, simplified parachute style harness.

It is another object of the invention to provide a buoyancy compensator or personal flotation device configured and attached to a user's body in such a manner that the user will float on a water surface in a stable, head up and out of water position.

It is a further object of the invention to provide a flotation vest in the form of a buoyancy compensator which is streamlined, comfortable, and safe in use and can be used for either skin or scuba diving.

Yet another object of the invention is to provide a buoyancy compensator suitable for scuba diving which is mounted on the diver's chest and includes connectors for securing a scuba tank backpack directly to the buoyancy compensator, thus eliminating the conventional waist belt and buckle of a scuba tank backpack.

Yet a further object of the invention is to provide a buoyancy compensator which includes an auxiliary equipment strap mounted in quick-disconnect fashion on the front of the buoyancy compensator.

Still another object of the invention is to provide a buoyancy compensator including a conveniently accessible, front mounted equipment pocket and a pair of side pockets for trimming weights and/or an extra second stage of a regulator, the side pockets including four triangular pockets interconnected by hook and loop fastener means whereupon the second stage of a scuba regulator may be firmly secured therein but easily detached therefrom by a simple pulling motion.

Still a further object of the invention is to provide a personal flotation device for use by canoeists, white water rafters and the like, the device being streamlined and comfortable to wear, and being filled with a foam material to provide adequate buoyancy, there being a lateral fold line intermediate of the personal flotation device to assure proper fit and comfort for the user.

It is still another object of the invention to provide a buoyancy compensator or personal flotation device including a harness assembly for attaching the vest or device to the body of a user, the harness including upper thigh encircling straps, there being no crotch strap in the harness assembly.

It is still a further object of the invention to provide a buoyancy compensator including a collar and backless waist coat assembly with side flaps as a part of the waistcoat and located beneath the armpits of the user, the entire buoyancy compensator being inflatable, thus providing greater stability for the diver when under water regardless of attitude, allowing unhindered maneuverability for the diver, and also providing a degree of insulation of the diver's body.

It is still another object of this invention to provide optional left or right handed inflation by placing the overpressure relief valve and the inflation hose fitting for the buoyancy compensator in mirror image fashion.

It is yet another object of this invention to provide a personal floatation device and a buoyancy compensator which is easily put on and taken off from a sitting position so as to be easily used by handicapped people confined to a wheelchair.

It is also an object of the invention to provide a buoyancy compensator and harness assembly whereby implosion of the buoyancy compensator during deflation is effectively prevented whereby full deflation of the buoyancy compensator beneath the surface of a body of water may be accomplished utilizing only ambient water pressure.

Further novel features and other objects and advantages of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which.

DESCRIPTION OF THE PREFERRED EMBODIMENTS

Figure 1:
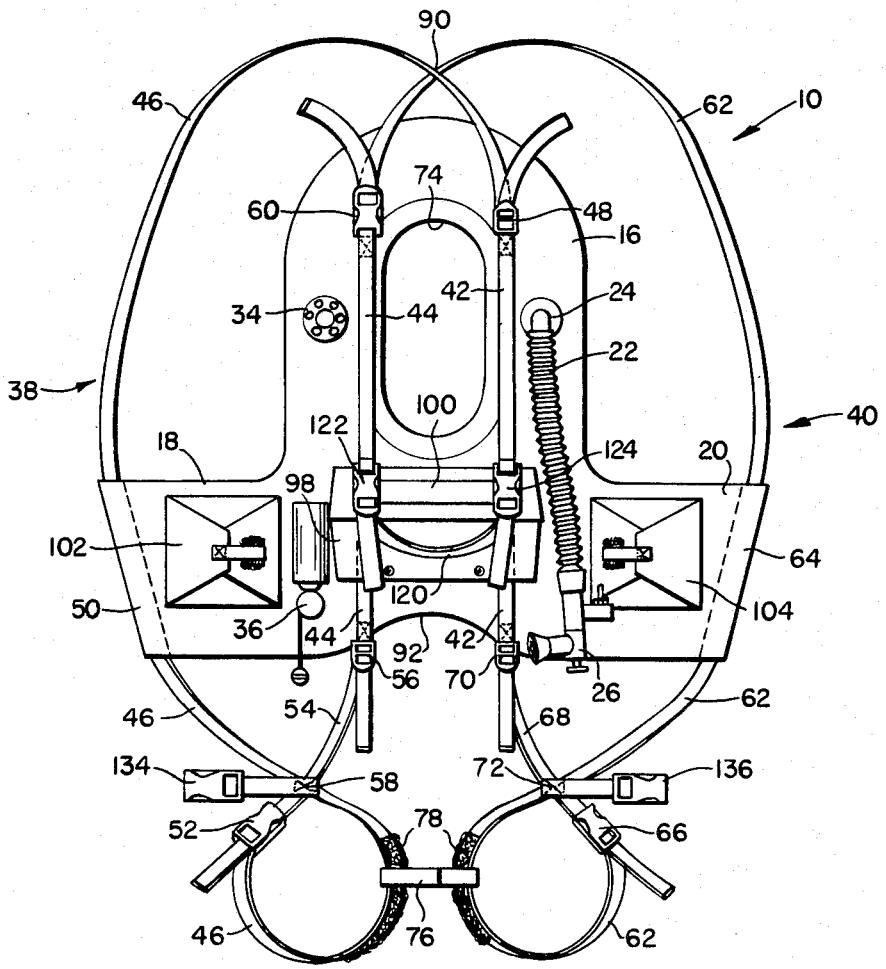
FIG. 1 is a plan view of the buoyancy compensator form of the invention.
Figure 11:
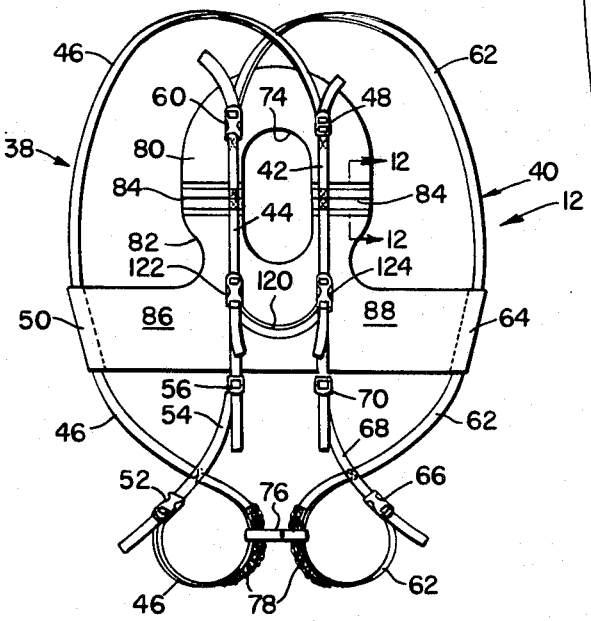
FIG. 11 is a plan view of the foam filled, personal flotation device form of the invention.
Figure 12:
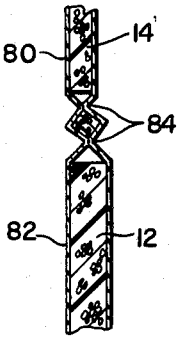
FIG. 12 is a detail, section view taken along Lines 12—12 of FIG. 11.

Referring now to the drawings by reference character and in particular to FIGS. 1 and 11 thereof, two embodiments of the flotation vest invention are illustrated, one being a buoyancy compensator 10 as shown in FIG. 1 and the other being a personal flotation device or PFD 12 which is illustrated in FIG. 11. The principal structural difference between the two forms of the invention is that buoyancy compensator 10 is inflatable and deflatable in otherwise conventional fashion as will be explained below while the PFD 12 is filled with a suitable, known foam material, as is illustrated in FIG. 12 at 14. Other differences will be explained below.

Returning to FIG. 1 of the drawings, buoyancy compensator 10 includes a unitary, backless, waistcoat and collar assembly 16 with a pair of side flaps 18, 20 which are structured to fit at the waist of the user and beneath the armpits. The entire interior of assembly 16 is inflatable as are side flaps 18 and 20. To this end, the interior of assembly 16 may be provided with an inflatable and deflatable bladder (not shown) which is completely similar in structure and function to bladders used in prior art buoyancy compensators. Only the shape of the bladder is different, as it includes extensions fitting into flaps 18 and 20.

There are further conventional features in buoyancy compensator 10. Specifically, a corrugated hose 22 communicates with the interior of assembly 16 or with a bladder in assembly 16 through a fitting 24. The free end of hose 22 is provided with an inflation/deflation mechanism 26 having a mouth piece for oral inflation of assembly 16 and a nipple fitting 28 to which is secured a low pressure hose (not shown) which is further connected to a source of air under pressure or tank 30 (FIGS. 6, 14) through a regulator 32 mounted on the tank (FIGS. 6, 14), again in conventional fashion. Other conventional components of assembly 16 include an over pressure relief valve 34, which vents excess pressure from within assembly 16 or the bladder therein in order to prevent rupture thereof, and a manually operated $CO_2$ inflation device 36, for emergency inflation of assembly 16 when needed.

Turning now to the salient features of the present invention, assembly 16 includes a pair of similarly constructed strap assemblies 38, 40 which together comprise a modified parachute harness, in some respects, but strap assemblies 38,40 are further designed and configured to assure that assembly 16 is retained on the diver's body in a streamlined fashion and assure that the center of buoyancy of the diver will be at the chest region, rather than at the neck of the diver, which is usually the case with prior art, front or chest mounted buoyancy compensators. Each strap assembly 38, 40 includes a secured portion 42, 44, respectively, which is stitched or otherwise suitably attached to the surface of assembly 16. Tracing strap assembly 38 from beginning to end, a strap segment 46 is attached to fixed strap 42 through an otherwise conventional adjustment buckle 48 and is dimensioned and arranged to extend downwardly across the right back of a user and slidably through a tubular opening 50 formed in the outer terminal edge of flap 18, and then across the upper right thigh of the diver, and back across the lower right buttock of the diver where strap 46 terminates in a conventional quick disconnect buckle 52. The free end of strap segment 46 is received through a lower end of buckle 52 and is adjustably locked therein. To the other end of buckle 52 is secured a short strap 54 which is connected to an adjustment buckle 56 secured at the lower end of fixed strap 44 of strap assembly 40. Additionally, short strap 54 is stitched or otherwise secured to strap segment 46 at 58.

Strap assembly 40 is constructed in mirror fashion to strap assembly 38 except that a quick disconnect buckle 60 is provided at the upper end of fixed strap 44, for reasons to be explained hereinbelow. Strap assembly 40 includes strap segment 62 adjustably secured through buckle 60. Strap segment 62 extends down the left backside of the diver, slidably through a tubular opening 64 formed in the laternal, terminal edge of flap 20. Strap segment 62 then extends across the upper left thigh of the diver, through the crotch and upwardly below the left buttock to a quick disconnect buckle 66, through which it is slidably connected. The other end of buckle 66 is connected to a short strap 68 which is connected to the lower end of fixed strap 42 by an adjustment buckle 70. Short strap 68 is stitched or otherwise suitably attached to strap segment 62 at 72, as shown.

As can be seen in FIG. 1, the upper ends of strap assemblies 38, 40 are secured to the collar portion of assembly 16 somewhat behind a neck opening 74 formed within and through assembly 16. Assemblies 38, 40 then extend downwardly and around portions of the body of the diver as explained and terminate at a lower end portion of waistcoat and collar assembly 16, at the buckles 56, 70 respectfully.

It can further be seen from FIG. 1 that strap segments 46 and 62 form loops about the upper thighs of the diver. For further security and comfort, a cross strap 76 is provided which loops together the portions of strap segments 46 and 62 which encircle the thighs of the diver. The cross strap 76 may be adjustably fixed in place by fabric hook and loop fastener means 78, such as that sold under the trademark "Velcro" which is manufactured by Velcro USA. As can be seen in FIG. 1, portions of strap segments 46 and 62 which encircle the thighs of the diver are provided with strips of hook and loop fastener means 78 so that the cross straps 76 may be adjusted therealong.

The various quick disconnect buckles 52, 60 and 66 are not novel per se. These buckles may be selected from a wide variety of those available on the market and may be metal or plastic, although hard plastic is preferred. An example of such a readily available buckle is the model SR-1 manufactured by Fastex of Des Plaines, Ill.

Similarly, the adjustment buckles 48, 56 and 70 are commonly available and may be made of metal or plastic, although hard plastic is preferred. One example of a suitable hard plastic buckle is also manufactured by Fastex of Des Plaines, Ill.

Referring again to FIG. 11, it will be noted that personal flotation device 12 also includes strap assemblies 38 and 40 which are exactly the same as the strap assemblies 38 and 40 of buoyancy compensator 10; accordingly, the same reference numerals have been employed in FIG. 11 for the detail components of the strap assemblies 38 and 40. As can be seen in FIG. 11, PFD 12 is also constructed as a unitary collar and backless waistcoat assembly but the assembly is divided into a collar portion 80 and a backless waistcoat 82 by fold lines or a pleated inner connection 84 so as to assure that PFD 12 will fit upon the body of the user in a streamlined fashion, with collar portion 80 laid down against the shoulders and upper back of the user. PFD 12 also includes a pair of side flaps 86 and 88 which are wrapped about the waist of the user and are located on a line generally beneath the armpits. In a preferred embodiment, it has been found that PFD 12 will have adequate buoyancy when the thickness of foam within collar 80 is about 1 and ½ inches and the same thickness of foam is also used within side flaps 86 and 88. However, foam thickness in the central body portion of waistcoat 82 is preferably is about two inches.

Figure 3:
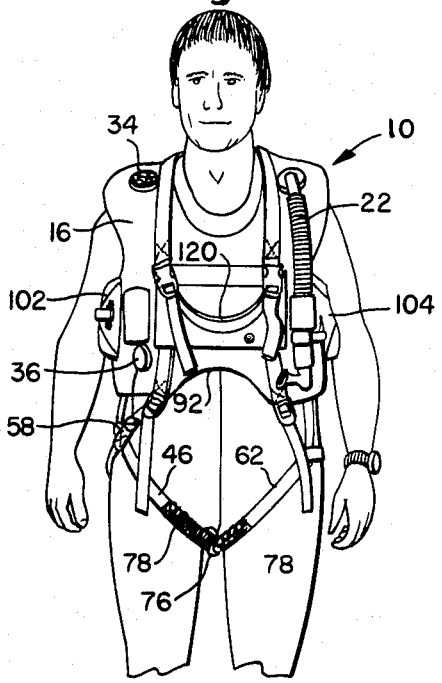
FIG. 3 is an elevation view showing the buoyancy compensator of the invention in place on a diver.

Turning now to FIGS. 1 and 3, placement of the buoyancy compensator 10 on the body of the diver will now be set forth. It should be noted that placement of PFD 12 (FIG. 11) is accomplished in the same manner as placement of buoyancy compensator 10.

First, the diver grasps buoyancy compensator 10 from behind, in the region of the collar portion of assembly 16, and with the left hand beneath strap 62 and the right hand beneath strap 46. At this point, buckles 52 and 66 are undone. The diver then checks to be sure that the "X" formed by the two straps 46 and 62 at 90 is above the hand. Next, the buoyancy compensator is placed on the body, with the diver's head extended through the neck opening 74. Then the buoyancy compensator is smoothed over the upper body and cross strap 76 is positioned so that it is slightly below the crotch. Straps 46 and 62 are then adjusted at adjustment buckle 48 and buckle 60 to lengthen or shorten straps 46 and 62 so that attachment point 58 and 72 rest on the head of the diver's femur. Thereafter, straps 46 and 62 are extended through the front of the crotch, about the right and left lower buttock of the diver, respectfully, and buckles 52 and 66 are connected together. Excess slack is taken up by manipulating the free ends of straps 46 and 62 at the buckles 52, 66, respectfully. Then the free ends of short straps 54 and 68 may be pulled downwardly a bit until a snug fit is assured. Preferably, this is done while buoyancy compensator 10 is slightly inflated in order to conform ideal positioning. Thus, the buoyancy compensator 10 is properly positioned for diving and this is illustrated in FIG. 3. This figure clearly illustrates another important aspect of the invention. Specifically, it can be seen that the lower, front terminal edge of the waistcoat is upwardly, generally arcuately configured at 92 to expose the waist area of the diver. This provides an open, easily accessible area so that the diver may easily reach and manipulate the quick release buckle 94 of a conventional weight belt 96 (FIG. 10) without confusing the same with other pieces of equipment on the front of the body. Of course, PFD 12 (FIG. 11) is not provided with this arcuate configuration because weight belts are not worn by canoeists, white water enthusiasts and the like. PFD 12, in other words, is designed and used for surface flotation only.

Referring again to FIG. 1, the lower central portion of waistcoat and collar assembly 16 may be provided with a generally elongate, equipment pocket 98 which includes a lid or cover 100 disconnectably attached thereto in a suitable fashion, such as by fabric hook and loop fastener means or "Velcro". Pocket 98 may be conveniently sized to hold equipment such as a pencil and standard dive tables printed on plastic or other suitably water proof material.

Side flaps 18 and 20 of buoyancy compensator 10 have auxiliary pockets 102, 104 on the respective front surfaces thereof which may have trimming weights placed therein in order to assist the diver in acquiring neutral buoyancy under water. More importantly, a selected pocket 102, for example, may be used to store a conventional, extra second stage or "octopus" regulator which can be used for shared breathing in an emergency.

Figure 4:
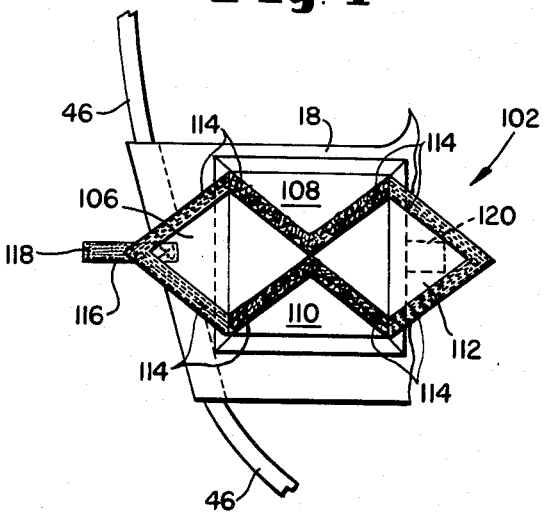
FIG. 4 is a detail, planned view of an auxiliary pocket of the invention.

The structure of the two pockets 102, 104 is identical. Pocket 102 is illustrated in detail in FIG. 4. Pocket 102 includes four triangular flaps 106, 108, 110, and 112 having their bases affixed to the front surface of flap 18, adjacent bases being arranging at approximately a right angle to one another, as illustrated. Adjacent side edges of each triangular flap are provided with suitable quick disconnect means such as fabric hook and loop fastener means or "Velcro" 114. Opposed pockets 106, 112 are further provided with a securement strap 116 which is stitched to flap 106 and is attached to flap 112 in quick disconnect fashion, as by fabric hook and loop fastener means or "Velcro" 118.

Figure 6:
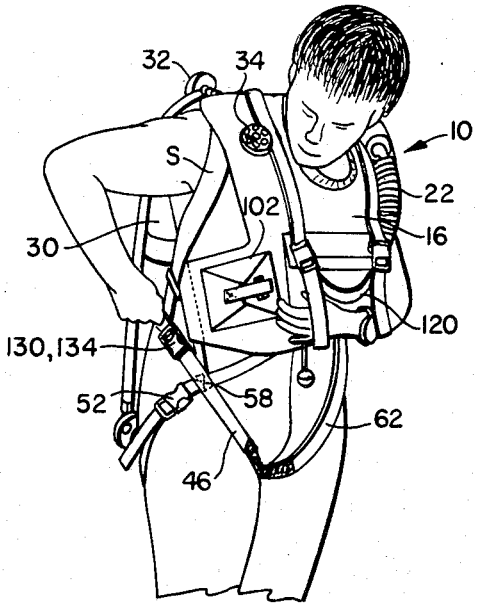
FIG. 6 is an elevation view of the buoyancy compensator invention on a diver, and further illustrating the diver attaching the scuba tank backpack to the harness of the buoyancy compensator.
Figure 7:
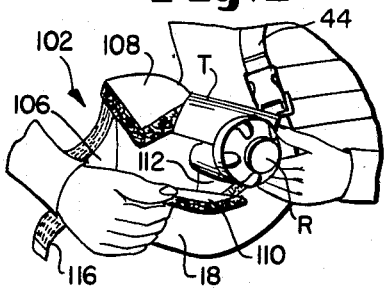
FIGS. 7, 8 and 9 are sequential views showing a diver placing an extra second stage of a scuba regulator in a side pocket of the buoyancy compensator.
Figure 8:
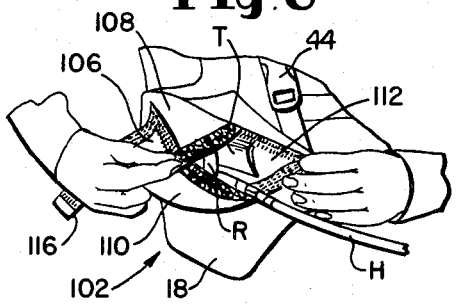
Figure 9:
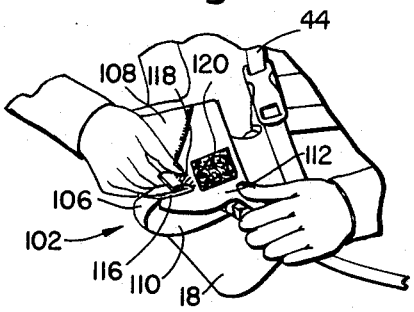

Referring now to FIGS. 7, 8 and 9, placement of an octopus second stage regulator R within pocket 102 and removal therefrom, as in case of an emergency, will be set forth. With the four flaps of pocket 102 in an open configuration, second stage R is inserted within the flaps, preferable in an upside down configuration with exhaust tee T disposed upwardly; this prevents free flow of the regulator and allows easy access to and use of the regulator in an emergency. As is seen in FIG. 8, top flap 108 and bottom flap 110 are then folded over second stage R. As is seen in FIG. 9, then the front flap 112 is folded over the flaps 108, 110 and the "Velcro" is secured. Finally, rear flap 106 is secured by "Velcro" to flaps 108, 110 in a similar manner and strap 116 is pulled across the completed pocket whereupon "Velcro" attachments 118, 120 are attached. Thus, the second stage regulator is secured within pocket 102 and protected from sand and dirt while the diver is underwater. Of course, regulator R includes a hose H which passes across the waist of the diver (FIG. 10), beneath the diver's left armpit and then to the first stage of the regulator 32 (FIG. 6).

Removal of the second stage R in an emergency situation is accomplished rather easily. First, the hose is manually located and the diver's hand is moved towards the pocket 102, as shown in FIG. 9. The strap 116 and flap 106 may be moved rearwardly in one motion to open the pocket. Thereafter, the hose and regulator may be moved towards the back of the diver and down to dislodge the second stage R from pocket 102. With only a little practice, this maneuver may be easily accomplished.

Figure 2:
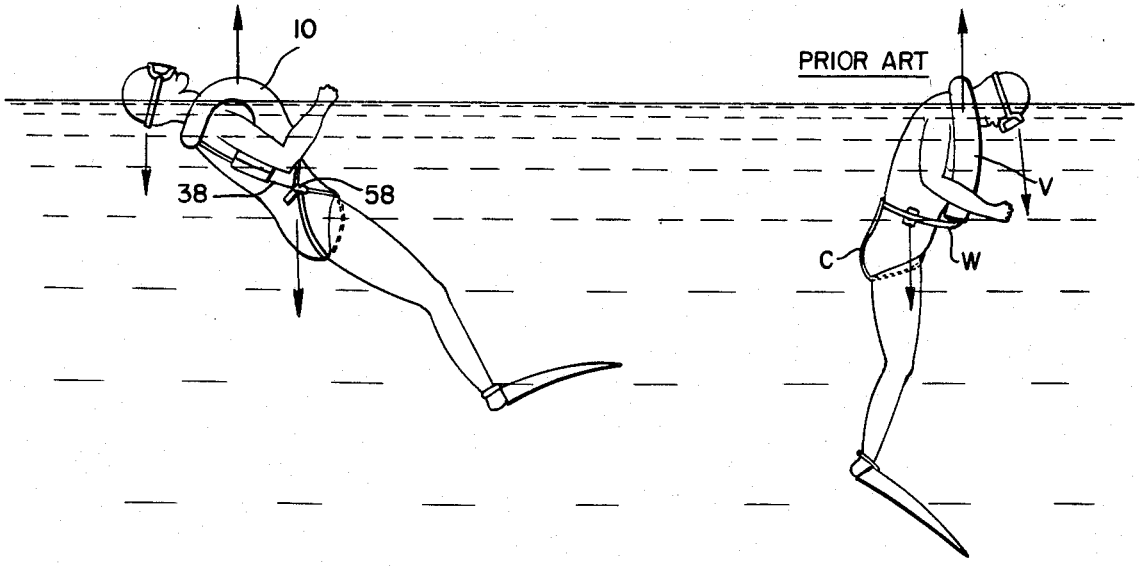
FIG. 2 is an elevation, diagrammatic view illustrating the buoyancy effect accomplished by the present invention on the left, compared with the buoyancy effect of a standard, prior art front mounted buoyancy compensator on the right.

FIG. 2 is a generally diagrammatic view illustrating a diver on the left equipped with the present buoyancy compensator invention and a second diver on the right who is wearing a conventional, front mounted buoyancy compensator. The buoyancy compensator of the diver on the right includes an inflatable vest V, a waist strap W and a crotch strap C. With this harness arrangement, the diver is actually free to move about inside the harness and the vest V easily moves out of position. Thus, with vest V inflated, the diver's center of buoyancy will be located in a plane forwardly of a plane drawn through the diver's center of gravity. Accordingly, the diver's head can actually be encouraged to drop forwardly, and being retained in a stable, face down position; obviously, this is unsafe and could be fatal in the case of an unconscious diver. The prior art vest V as shown may be provided with an additional strap connecting the top of the vest V, behind the diver's head with crotch strap C but even this arrangement can leave the diver in the water in a stable, face down position. Additionally, such an arrangement with a crotch strap C is often uncomfortable and sometimes painful.

In direct contradistinction thereto, the buoyancy compensator 10 of this invention is so secured to the diver's body as to retain the collar portion of buoyancy compensator 10 flat against the upper back and shoulders of the diver, thus assuring that the diver's center of buoyancy is located at the chest, rather then behind the neck. With a center of buoyancy so located, a vertical plane drawn through the diver's center of buoyancy will be located to the left of the diver's center of gravity, in the sense of FIG. 2. Additionally, the harness of this invention used with buoyancy compensator 10 does not permit the invention to move out of position, as is the case with prior art vests. With this arrangement, the head of the diver is actually forced to drop back and thus it is assured that the diver will float on the surface of the water in a stable, face up position. It should be further noted that this discussion applies equally to the PFD invention illustrated in FIG. 11.

Figure 10:
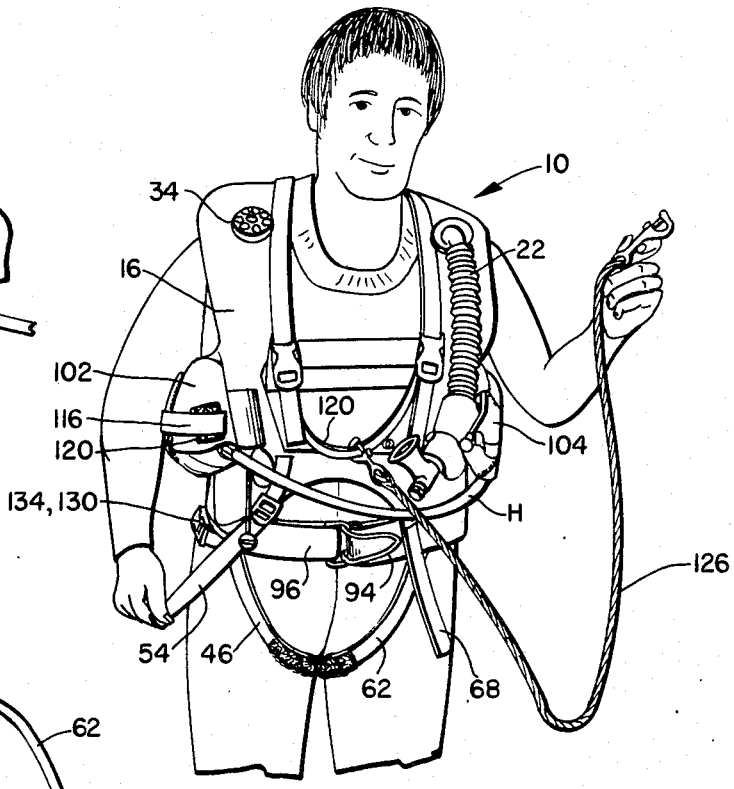
FIG. 10 is an elevation view of the buoyancy compensator invention on a diver and illustrating adjusting of a harness strap at the left of the figure and use of the auxiliary equipment strap of the invention in the center and to the right of the figure.

Turning now to FIGS. 1 and 10, the buoyancy compensator 10 may be provided with a laternally arranged, auxiliary equipment retaining strap 120 located at the elongate pocket 98 and attached to fixed straps 44, 42 by additional quick disconnect buckles 122, 124. Equipment strap 120 is useful for carrying the diver's miscellaneous equipment (such as diving mask, fins, etc) to the dive site from a dressing area without having to carry such equipment in his hands. While diving, particularly in low visibility conditions, a otherwise conventional buddy line 126 (FIG. 10) may be attached to equipment strap 120. If the diver wishes, he may swim on the surface from place to place before or after a dive and secure equipment strap 120; thus, the diver will not have to carry extra equipment with his hands. This strap may also be used as a lifting device to aid exiting the water, to help handicapped people into and out of the water, to facilitate rescue and, with heavier strapping and buckles, for high speed boat and helicopter extrication. If desired, PFD 12 may be similarly provided with an equipment strap 120, as is illustrated in FIG. 11.

Figure 5:
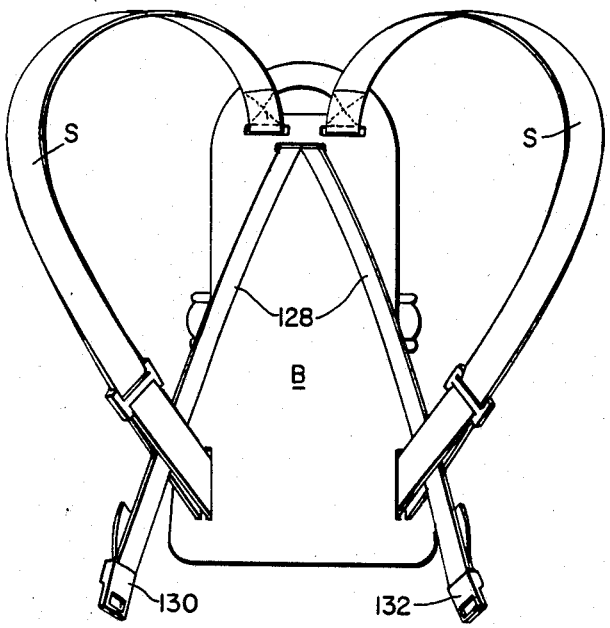
FIG. 5 is an elevation view of an otherwise conventional scuba tank backpack provided with connectors for attaching the lower end of the backpack to the buoyancy compensator of this invention.

As was briefly stated above, the buoyancy compensator 10 may be modified in two different embodiments in order to secure an otherwise conventional scuba backpack and tank directly to the harness of the buoyancy compensator 10. Thus, the conventional waist belt and buckle of such a backpack may be eliminated and a significant safety advantage is thereby attained because no extra waist buckle is present which might be confused with a weight belt buckle such as 94, as shown in FIG. 10. One embodiment of such an arrangment is illustrated in FIGS. 5 and 6. FIG. 5 shows a conventional backpack B with its shoulder straps S but the waist belt and buckle has been removed. These are replaced by a harness attachment strap 128, looped through the upper portion of the backpack B as shown. The lower free ends of strap 128 are inserted through the lower, respective adjustment loops of shoulder straps S and terminate in a pair of quick disconnect buckle portions 130, 132. Referring again to FIG. 1, mating buckle segments 134, 136 for buckle portions 130, 132, respectfully, are provided at attachment points 58 and 72. Referring again to FIG. 6, regulator 32 is attached to tank 30 in the usual manner and the diver dons the tank and regulator by placing straps S over the shoulders. Then buckle portion 130 is attached to buckle segment 134 and buckle portion 132 is attached to buckle segment 136. The free ends of the strap 128 at buckle portions 130, 132 may be adjusted to comfortably but firmly secure the tank backpack to the diver's back. Thus, a conventional backpack and tank assembly is secured with the respective lower ends of the backpack being effectively attached to the harness assembly of buoyancy compensator 10.

The buckles made up of members 130, 134 and 132, 136 are not novel per se. An example of such a suitable buckle assembly is disclosed in U.S. Pat. No. 3,200,464, the disclosure, of which is incorporated herein by reference. Buckles 130, 134 and 132, 136 are of a different style than buckles 66 and 52, being of the thumb depress quick release style instead of a finger squeeze style to preclude their being mistaken in an emergeny.

Figure 13:
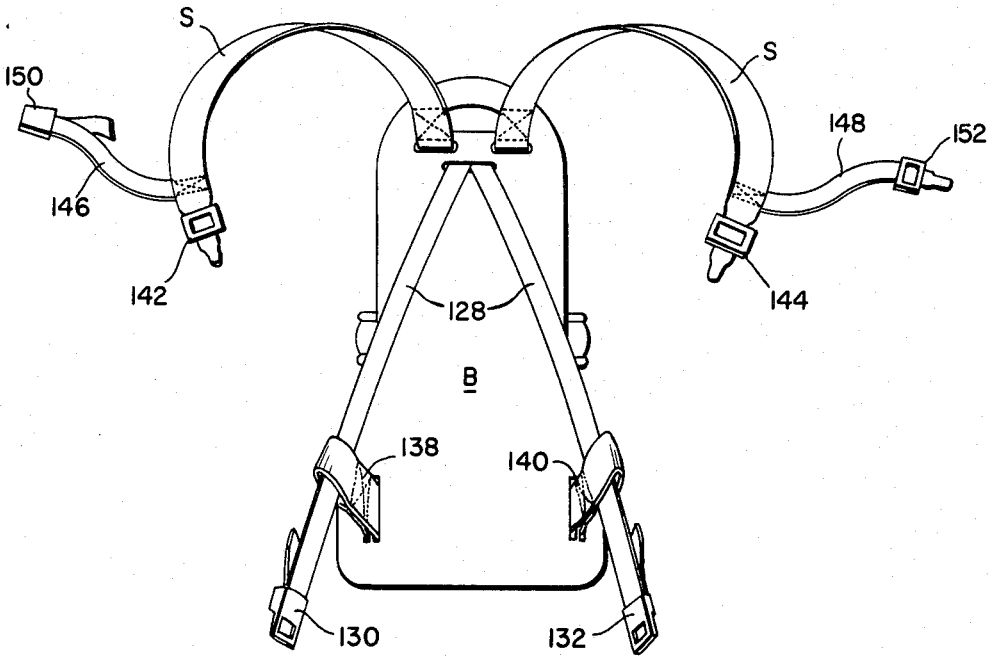
FIG. 13 is an elevation view similiar to FIG. 5 showing another embodiment of straps and connectors for securing an otherwise conventional scuba tank backpack to the buoyancy compensator invention.
Figure 14:
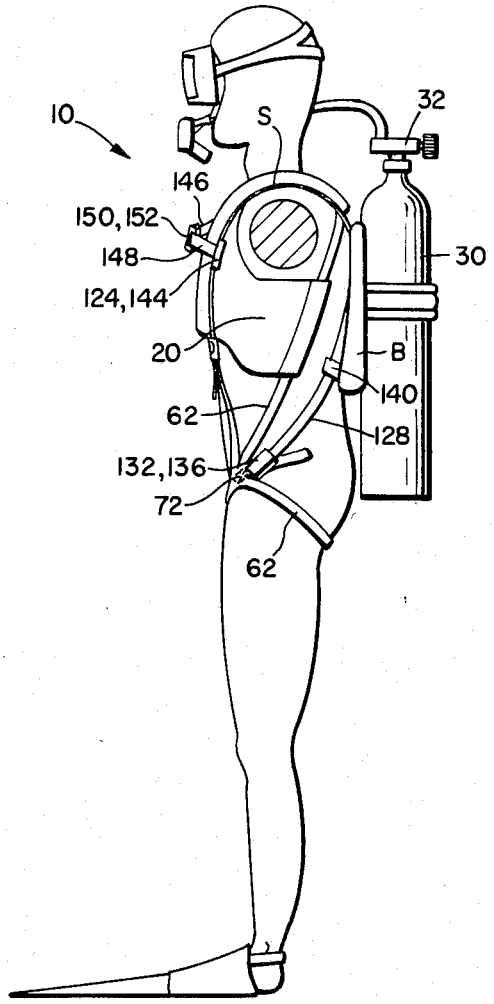
FIG. 14 is a side elevation view, partly in section, showing a diver equipped with the buoyancy compensator invention and the scuba tank backpack embodiment illustrated in FIG. 13.

A second embodiment of attaching an otherwise conventional backpack and tank assembly to the harness of buoyancy compensator 10 is illustrated in FIGS. 13 and 14. In this embodiment, both the upper and lower portions of the backpack B are directly secured to the strap 128 with its buckle portions 130 and 132 is provided as in the embodiment of FIG. 5. However, the shoulder straps S have been severed, the lower portions thereof being looped and stitched upon themselves thus to form laternal strap loops 138 and 140, which serve as sleeves or guides for the respective free end portions of strap 128. The free ends of shoulder straps S are terminated as shown and provided with quick release buckle portions 142, 144 respectively, which conveniently mate with buckle portions of buckles 122, 124 for equipment strap 120 (FIG. 1). Of course, in this embodiment, equipment strap 120 as previously disclosed is detached and removed. In place thereof equipment strap may be provided which is either directly attached to the end portions of shoulder straps S, immediately above buckle portions 142 and 144 or is formed from the excess of shoulder strap S. This strap includes segments 146 and 148 each having an end stitched to shoulder straps S. The free ends of 146 and 148 are provided with quick disconnect buckle components 150, 152.

FIG. 14 illustrates the embodiment of the invention shown in FIG. 13 in place on a diver. Tank 30 may be held by an assistant or supported on a surface whereupon shoulder straps S as shown in FIG. 13 are attached to the harness of buoyancy compensator 10 as explained. Thereafter, the lower buckles 130 and 132 are attached to the buckles 134 and 136, respectively, of the harness.

Returning again to FIG. 10, a fully equipped diver is shown, ready for scuba diving. The free ends of straps 54 and 68 are left to drape outwardly over weight belt 96 so that if adjustment of buoyancy compensator 10 is needed under water, these straps may be easily found and manipulated. However, these straps will not interfere with the quick release buckle 94 of weight belt 96, should the weight belt need to be ditched, as in case of an emergency.

After the dive is completed and the rest of the equipment is removed, buoyancy compensator 10 may be easily removed by the diver without need of an assistance. The diver simply reaches over his right shoulder with his right hand and disconnects quick release buckle 60 (FIG. 1). Thereafter, quick disconnect buckles 52 and 66 at the thighs may be released and the buoyancy compensator is pulled off over the head. (PFD 12 is removed in the same manner). Equipment on strap 120 may be left in place so that it will not be lost. This is a particular advantage on a crowded dive platform, such as a boat.

In summary, then, the present invention provides a flotation device which inparts desired surface control of buoyancy in both the buoyancy compensator and PFD configuration. The "butterfly" shape of the buoyancy compensator provides a wrap around device for the diver's body so that under water buoyancy control is greatly enhanced. Unlike previous designs having waist encircling straps connected to the lower terminal corners of the front mounted vest, the harness assembly of the present invention is not connected directly in the back; thus, there is no constricting effect on the diver's body due to inflation of the buoyancy compensator. With both embodiments of the invention, the wrap around design provides a greater degree of under arm buoyancy which assures that the user's head will be floated well out of water at the surface. The buoyancy compensator invention provides greater insulation for the diver, resulting in less body heat loss, because of the wrap around design. Unhindered control of maneuverability for the diver is provided because air within the buoyancy compensator may travel freely from one part of the buoyancy compensator to any other when the diver moves from any one attitude to any other. By way of example, if the diver assumes a somewhat vertical, head down, feet up position, enhanced buoyancy control is provided because air moves into the side flaps or wings which results in moving the moment arm of buoyant force nearer to the diver's weight belt. Further, the structure of the buoyancy compensator and the harness permit water pressure to assist in deflation of the buoyancy compensator. The harness is designed so that there is no implosion of the buoyancy compensator during deflation. In point of fact, tests have shown that even an uncontrolled ascent can be stopped prior to reaching the surface by utilizing only ambient water pressure.

Of particular importance with regard to the buoyancy compensator invention is that it may be used alone or with a scuba tank and backpack, with the scuba unit and buoyancy compensator being an intergrated unit. Additionally, the straps are very easily adjusted to "custom fit" the user and importantly, the hip connector and front adjusting buckles may be adjusted under water rather easily.

Finally, it should be noted that the invention is completely streamlined. The buoyancy compensator is comfortably tied down to the diver's body. This streamlining greatly reduces the effort required on the part of the diver to swim through water. Also, the harness design completely eliminates the uncomfortable and even painful prior art crotch strap and yet secures the flotation vest more securely to the user's body.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalence of the claims are therefore intended to be embraced therein.

What is claimed and desired to be secured by Letters Patent is:

1. A flotation vest for supporting the body of a user in water comprising a unitary, backless, waistcoat and collar assembly, the collar being in the general configuration of a stole, the waistcoat having a pair of side flap means located, approximately, at the waist of a user, beneath the armpits; flotation means within said waistcoat and collar assembly; harness means for securing said waistcoat and collar assembly to the body of a user, comprising a pair of strap assemblies, each strap extending along the back of a user to a terminal, generally vertical edge of a flap means with which is is engaged, said strap further extending along the front of an upper thigh region of a user, and encircling the upper thigh region of a user by being extended through a user's crotch, behind the buttock, and terminating by being connected to itself at that portion of said strap extending across the front of an upper thigh portion of said waistcoat, the portions of said straps extending from the collar to an associated flap means being free of a fixed connection to one another; and a cross strap looping together portions of said straps located at the crotch of a user, said cross strap further comprising fabric hook and loop fastener means for securing said cross strap in place.

2. The flotation vest as claimed in claim 1 wherein each strap is slidably engaged through said edge of its associated flap means.

3. The flotation vest as claimed in claim 1 wherein one of said fabric hook and loop fastener means is located along a substantial length of each strap in the vicinity of the crotch of a user, for adjustable placement of said cross strap.

4. The flotation vest as claimed in claim 1 further comprising inflation and deflation means for inflating and deflating said flotation vest flotation means, said waistcoat and collar assembly and said pair of side flap means including said flotation means and being inflatable and deflatable by said inflation and deflation means.

5. The flotation vest as claimed in claim 4 wherein at least one of said side flap means includes auxiliary pocket means mounted on an external surface of said one side flap means, for holding and retaining auxiliary equipment, said pocket means including four triangular flaps having their bases secured to said flap means, adjacent triangular flap bases being arranged at approximately a right angle to one another, said triangular flaps being sized and arranged so that adjacent side edges of any two triangular flaps overlie one another when the pocket means are closed, there being means on each side edge of each triangular flap for securing adjacent triangular flap side edges together in quick disconnect fashion.

6. The flotation vest as claimed in claim 5 wherein a selected pair of opposed triangular flaps are further provided with quick disconnect means for securing the apices of said opposed triangular flaps together.

7. The flotation vest as claimed in claim 5 wherein said means for securing said triangular flap side edges together comprise fabric hook and loop fastener means.

8. The flotation vest as claimed in claim 6 wherein said quick disconnect means for securing the apices of opposed-triangular flaps together comprise fabric hook and loop fastener means.

9. The flotation vest as claimed in claim 1 wherein waistcoat further comprises a laterally arranged, auxiliary equipment retaining strap having its ends attached to a front surface of said waistcoat, there being at least one quick disconnect means for attaching a selected end of said auxiliary equipment strap to said waistcoat.

10. The flotation vest as claimed in claim 1 wherein said waistcoat further comprises a generally elongate equipment pocket attached laterally to the front surface of said waistcoat.

11. The flotation vest as claimed in claim 1 wherein a lower, front terminal edge of said waistcoat is upwardly, generally arcuately configured, thus to expose the waist area of a user.

12. The flotation vest as claimed in claim 1 wherein each said strap in the area of connection of a strap end to the portion of the strap in the front upper thigh region of a user further comprises additional connection means for securing the lower respective end corners of an otherwise conventional scuba backpack thereto.

13. The flotation vest as claimed in claim 12 further comprising, in assembly, an otherwise conventional scuba backpack, the lower respective end corners of said backpack further including attachment means for connecting said backpack end corners to the additional connection means of said flotation vest.

14. The flotation vest as claimed in claim 12 wherein said waistcoat further comprises a pair of scuba backpack harness connection means located on the chest region of the waistcoat for securing the upper portion of an otherwise conventional scuba backpack thereto.

15. The flotation vest as claimed in claim 14 further comprising, in assembly, an otherwise conventional scuba backpack, the upper portion of which is provided with limited length securement straps arranged to be arrayed over the respective shoulders of a user, the free ends of said securement straps having attachment means for connecting said securement straps to said waistcoat mounted backpack harness connection means.

16. The flotation vest as claimed in claim 1 wherein said flotation means comprise a buoyant, cellular foam material.

17. The flotation vest as claimed in claim 16, there being fold lines formed in said flotation vest, laterally thereacross, at the approximate junction of said collar with said waistcoat.

18. A flotation vest for supporting the body of a user in water comprising a unitary, backless, waistcoat and collar assembly, the collar being in the general configuration of a stole, the waistcoat having a pair of side flap means located, approximately, at the waist of a user, beneath the armpits; flotation means within said waistcoat and collar assembly; harness means for securing said waistcoat and collar assembly to the body of a user, comprising a pair of strap assemblies, each strap assembly including a strap secured to the collar, said strap extending along the back of a user to a terminal, generally vertical edge of a flap means with which it is engaged, said strap further extending along the front of an upper thigh region of a user, and encircling the upper thigh region of a user by being extended through a user's crotch, behind the buttock, and terminating by being connected to itself at that portion of said strap extending across the front of an upper thigh region of a user, and thence further connected to a lower end portion of said waistcoat, each said strap being slidably engaged through said edge of its associated flap means; there further being a cross strap looping together portions of said straps located at the crotch of a user and means for selecting affixing said cross strap to said strap portions along the length of said strap portions; inflation and deflation means for inflating said collar and waistcoat assembly, including said side flap means, said pocket means including four triangular flaps arranged to have their side edges and apices overlie one another when said pocket means are closed, adjacent bases of said traingular flaps being fixed to said one side flap neans at about a right angle to one another, each edge of each triangular flap including means for attaching itself to an adjacent edge in quick disconnect fashion; a laterally arranged, auxiliary equipment retaining strap having its ends attached to a front surface of said waistcoat, there being at least one quick disconnect means for attaching a selected end of said auxiliary equipment strap to said waistcoat; a generally elongate equipment pocket attached to said waistcoat immediately beneath said auxiliary equipment retaining strap; additional connection means on each said strap in the area of connection of a strap end to the portion of the strap in the front upper thigh region of the user for attachment to the lower end corners of an otherwise conventional scuba backpack and backpack harness connection means located at the ends of the auxiliary equipment strap for securing the upper end of an otherwise conventional scuba backpack thereto; and means forming the lower, front terminal edge of said waistcoat in an upwardly, generally arcuate configuration, thus to expose the waist area of a user, the portions of said straps extending from the collar to an associated flap means being free of a fixed connection to one another.

* * * * *